US012693035B2

(12) United States Patent
Nayak

(10) Patent No.: US 12,693,035 B2
(45) Date of Patent: Jul. 28, 2026

(54) SYSTEM AND METHOD FOR DETERMINING AND MAINTAINING A HUMIDITY LEVEL IN AN AREA OF INTEREST

(71) Applicant: Carrier Corporation, Palm Beach Gardens, FL (US)

(72) Inventor: Subhasish Nayak, Hyderabad (IN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 106 days.

(21) Appl. No.: 18/731,219

(22) Filed: May 31, 2024

(65) Prior Publication Data

US 2024/0401826 A1 Dec. 5, 2024

Related U.S. Application Data

(60) Provisional application No. 63/506,089, filed on Jun. 4, 2023.

(51) Int. Cl.
*F24F 11/00* (2018.01)
*F24F 11/64* (2018.01)
(Continued)

(52) U.S. Cl.
CPC ..... *F24F 11/0008* (2013.01); *F24F 11/64* (2018.01); *F24F 2110/12* (2018.01); *F24F 2110/20* (2018.01)

(58) Field of Classification Search
CPC ..... F24F 11/0008; F24F 11/64; F24F 11/72; F24F 11/54; F24F 2110/10; F24F 2110/12; F24F 2110/20
See application file for complete search history.

(56) References Cited

U.S. PATENT DOCUMENTS

RE33,600 E * 6/1991 Timmons ..... G05D 23/1931 236/44 C
5,598,971 A * 2/1997 Winther ..... F24F 11/63 62/3.4

(Continued)

FOREIGN PATENT DOCUMENTS

CN 104613568 A 5/2015
CN 107421079 A * 12/2017 ..... F24F 11/0008

(Continued)

OTHER PUBLICATIONS

Extended European Search Report received for EP Application No. 24179431.2, mailed on Nov. 13, 2024, 6 Pages.

*Primary Examiner* — Nelson J Nieves
(74) *Attorney, Agent, or Firm* — Souad Hakim

(57) ABSTRACT

A system for determining a humidity level for an area of interest (AOI) is disclosed. The system comprises a first sensor operable to monitor ambient air temperature outside the AOI, a second sensor operable to monitor dew point temperature within the AOI, and a processing device in communication with the first sensor and the second sensor. The processing device comprises one or more processors coupled to a memory storing instructions executable by the one or more processors, wherein the processing device is configured to receive, from the first sensor, the ambient air temperature being monitored outside the AOI, receive, from the second sensor, the dew point temperature being monitored within the AOI, and determine a humidity level to be maintained within the AOI based on the received ambient air temperature and the received dew point temperature.

15 Claims, 4 Drawing Sheets

(51) Int. Cl.
*F24F 110/12* (2018.01)
*F24F 110/20* (2018.01)

(56) References Cited

U.S. PATENT DOCUMENTS 6,220,039 B1 * 4/2001 Kensok ..... F24F 11/61 62/93
6,826,920 B2 12/2004 Wacker
7,574,871 B2 8/2009 Bloemer et al.
9,097,432 B2 8/2015 Kreft et al.
9,188,993 B2 11/2015 Wenzel
9,500,379 B2 11/2016 Schnell et al.
10,216,161 B2 2/2019 Banerjee et al.
10,712,037 B2 7/2020 Brahme et al.
11,035,585 B2 6/2021 Ram
11,493,220 B2 11/2022 Ajax et al.
11,662,108 B2 5/2023 Moffitt
11,802,711 B2 * 10/2023 Sato ..... F24F 11/64
2011/0061477 A1 3/2011 Fitz
2014/0349563 A1 * 11/2014 Honda ..... F24F 1/0035 454/256
2018/0059695 A1 * 3/2018 Carignan ..... G05D 27/02
2021/0131681 A1 5/2021 Duncan
2021/0310684 A1 * 10/2021 Sasaki ..... F24F 11/63
2022/0090807 A1 3/2022 Grefsheim et al.
2022/0163225 A1 * 5/2022 Balazs ..... F24F 11/64
2023/0115095 A1 * 4/2023 Schubert ..... F24F 11/49 700/277
2024/0003564 A1 * 1/2024 Klein ..... F24F 11/64

FOREIGN PATENT DOCUMENTS

CN 107367023 B 5/2020
CN 115289648 A * 11/2022 ..... F24F 11/61
CN 114738961 B * 2/2024 ..... F24F 11/64
DE 102014107119 A1 11/2015
WO WO-2019075821 A1 * 4/2019 ..... F24F 11/871
WO 2021119068 A1 6/2021

* cited by examiner

SYSTEM AND METHOD FOR DETERMINING AND MAINTAINING A HUMIDITY LEVEL IN AN AREA OF INTEREST

CROSS-REFERENCE TO RELATED APPLICATION

This patent application claims the benefit of U.S. Provisional Patent Application No. 63/506,089, filed on Jun. 4, 2023, which is incorporated by reference herein in its entirety.

BACKGROUND

This invention relates to the field of indoor air quality management systems, and more particularly, a system and method for determining a humidity level for an area of interest (AOI) or environment and further maintaining the determined humidity level within the AOI.

In an environment such as a building or enclosed space, maintaining an optimum indoor humidity level may be important to provide comfort to occupants. Such an environment may be equipped with an HVAC system or a humidifier to maintain a user-defined humidity level as set by the occupants based on their comfort. However, the occupants may be unaware of the optimum humidity level which may provide comfort to them as well as save energy and optimize the HVAC system or humidifier.

SUMMARY

Described herein is a system for determining a humidity level for an area of interest (AOI). The system comprises a first sensor operable to monitor ambient air temperature outside the AOI, a second sensor operable to monitor dew point temperature within the AOI, and a processing device in communication with the first sensor and the second sensor, wherein the processing device comprises one or more processors coupled to a memory storing instructions executable by the one or more processors, wherein the processing device is configured to receive, from the first sensor, the ambient air temperature being monitored outside the AOI, receive, from the second sensor, the dew point temperature being monitored within the AOI, and determine a humidity level to be maintained within the AOI based on the received ambient air temperature and the received dew point temperature.

In one or more embodiments, the processing device is configured to map the received ambient air temperature and the received dew point temperature with a database comprising one or more known outdoor air temperatures, one or more known dew point temperatures, and a corresponding a predetermined humidity level, to determine the humidity level to be maintained within the AOI.

In one or more embodiments, the processing device is operatively connected to an HVAC system associated with the AOI, wherein the processing device is configured to transmit data comprising the determined humidity level for the AOI to a control unit of the HVAC.

In one or more embodiments, the processing device is in communication with an air humidification system associated with the AOI, wherein the processing device is configured to transmit data comprising the determined humidity level for the AOI to a control unit of the humidification system.

In one or more embodiments, the first sensor is positioned outside the AOI, and the second sensor is positioned inside the AOI.

In one or more embodiments, the processing device is a thermostat associated with an HVAC system of the AOI.

In one or more embodiments, the processing device is in communication with a thermostat associated with an HVAC system of the AOI.

Also described herein is a system for maintaining a humidity level within an area of interest (AOI). The system comprises a first sensor operable to monitor ambient air temperature outside the AOI, a second sensor operable to monitor dew point temperature within the AOI, and a processing device in communication with the HVAC system, the first sensor and the second sensor, wherein the processing device comprises one or more processors coupled to a memory storing instructions executable by the one or more processors, wherein the processing device is configured to receive, from the first sensor, the ambient air temperature being monitored outside the AOI, receive, from the second sensor, the dew point temperature being monitored within the AOI, determine a humidity level to be maintained within the AOI based on the received ambient air temperature and the received dew point temperature, and operate one or more of an HVAC system and an air humidification system associated with the AOI to maintain the determined humidity level within the AOI.

In one or more embodiments, the processing device is configured to map the received ambient air temperature and the received dew point temperature with a database comprising one or more known outdoor air temperatures, one or more known dew point temperatures, and a corresponding predetermined humidity level, to determine the humidity level to be maintained within the AOI.

In one or more embodiments, the first sensor is configured with an outdoor unit associated with the HVAC system of the AOI, and the second sensor is positioned inside the AOI.

In one or more embodiments, the processing device is a thermostat associated with the HVAC system of the AOI.

In one or more embodiments, the processing device is in communication with a thermostat associated with an HVAC system of the AOI.

In one or more embodiments, the processing device is in communication with a control unit associated with the HVAC system or the air humidification system associated with the AOI.

Further described herein is a method for determining a humidity level for an area of interest (AOI). The method comprises the steps of monitoring and receiving an ambient air temperature value outside the AOI, monitoring and receiving a dew point temperature value within the AOI, and determining a humidity level to be maintained within the AOI based on the received ambient air temperature and the received dew point temperature.

In one or more embodiments, the method comprises the steps of mapping the received ambient air temperature value and the received dew point temperature value with a database comprising one or more known outdoor air temperatures, one or more known dew point temperatures, and a corresponding predetermined humidity level, to determine the humidity level to be maintained within the AOI.

In one or more embodiments, the method comprises the steps of operating an HVAC system associated with the AOI to maintain the determined humidity level within the AOI.

In one or more embodiments, the method comprises the steps of operating an air humidification system associated with the AOI to maintain the determined humidity level within the AOI.

The foregoing summary is illustrative only and is not intended to be in any way limiting. In addition to the illustrative aspects, embodiments, and features described above, further aspects, embodiments, features, and techniques of the subject disclosure will become more apparent from the following description taken in conjunction with the drawings.

BRIEF DESCRIPTION OF THE DRAWINGS

The accompanying drawings are included to provide a further understanding of the subject disclosure and are incorporated in and constitute a part of this specification. The drawings illustrate exemplary embodiments of the subject disclosure and, together with the description, serve to explain the principles of the subject disclosure.

In the drawings, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION

Figure 1:
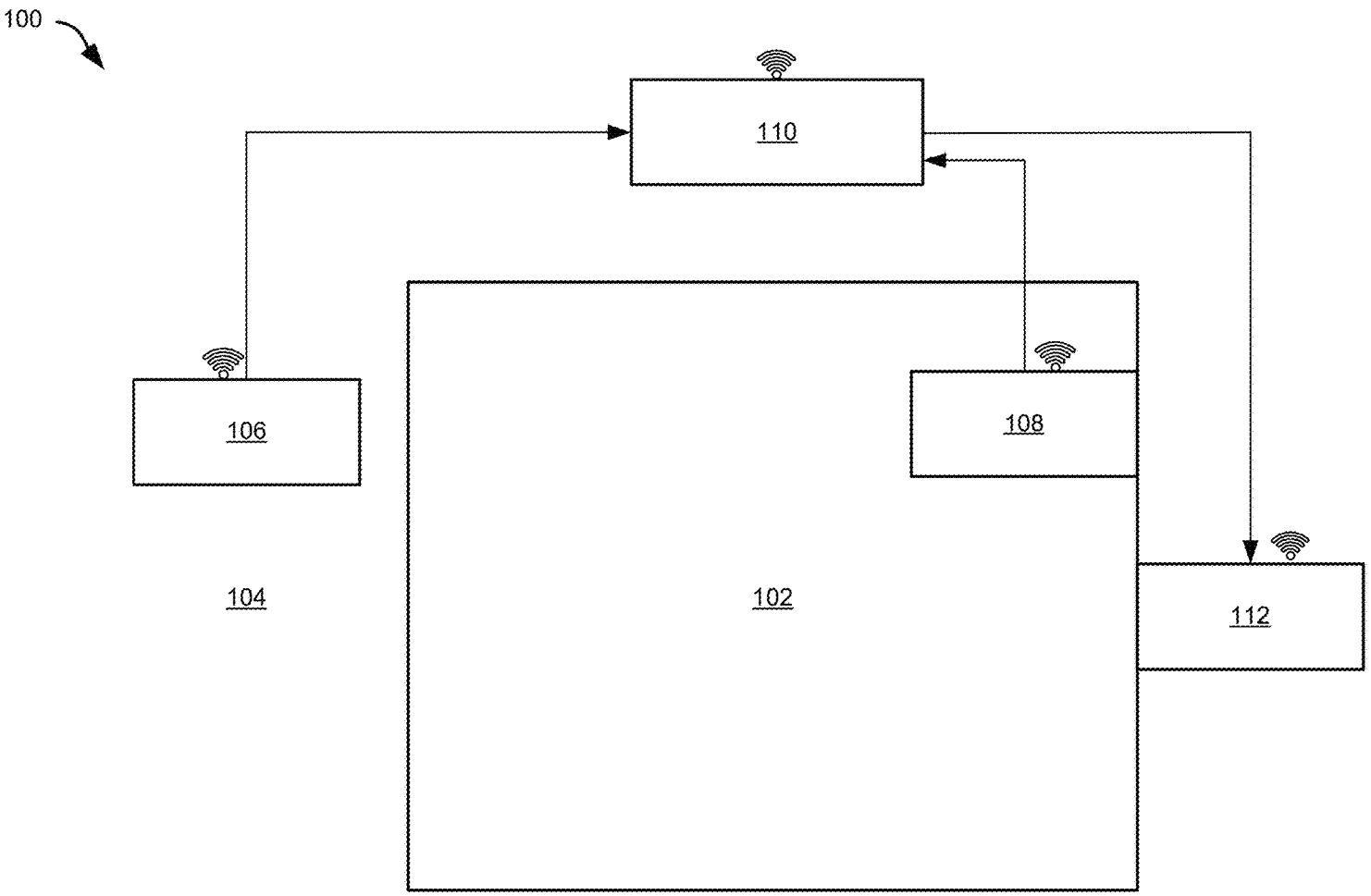
FIG. 1 illustrates an exemplary representation of a system for determining an optimum humidity level for an area of interest (AOI) and further maintaining the determined optimum humidity level within the AOI, in accordance with one or more embodiments of the subject disclosure.

The following is a detailed description of embodiments of the subject disclosure depicted in the accompanying drawings. The embodiments are in such detail as to clearly communicate the subject disclosure. However, the amount of detail offered is not intended to limit the anticipated variations of embodiments; on the contrary, the intention is to cover all modifications, equivalents, and alternatives falling within the spirit and scope of the subject disclosure as defined by the appended claims.

Various terms are used herein. To the extent a term used in a claim is not defined below, it should be given the broadest definition persons in the pertinent art have given that term as reflected in printed publications and issued patents at the time of filing.

In the specification, reference may be made to the spatial relationships between various components and to the spatial orientation of various aspects of components as the devices are depicted in the attached drawings. However, as will be recognized by those skilled in the art after a complete reading of the subject disclosure, the components of this invention, described herein may be positioned in any desired orientation. Thus, the use of terms such as "above," "below," "upper," "lower," "first", "second" or other like terms to describe a spatial relationship between various components or to describe the spatial orientation of aspects of such components should be understood to describe a relative relationship between the components or a spatial orientation of aspects of such components, respectively, described herein may be oriented in any desired direction.

In an environment such as a building or enclosed space, maintaining an optimum indoor humidity level may be important to provide comfort to occupants. Such an environment may be equipped with an HVAC system or a humidifier to maintain a user-defined humidity level as set by the occupants based on their comfort. The user may set the humidity level using a thermostat associated with the HVAC system or humidifier. However, the occupants may be unaware of the optimum humidity level which may provide comfort to them as well as save energy and optimize the HVAC system or humidifier.

Moreover, the optimum humidity level may vary based on regions as well as the outdoor temperature and dew point temperature within the environment, which the existing solution fails to consider, thereby making the existing solutions ineffective and unreliable. This also makes it difficult for the occupants to manually set the humidity level based on their comfort. For instance, in an example, an outdoor temperature of 30° F. and a dew point temperature of 30° F. may have a relative humidity of 100%, but a temperature of 80° F. and a dew point of 60° F. may produce a relative humidity of 50%. As a result, it may feel much more "humid" on the 80° F. day with 50% relative humidity than on the 30° F. day with 100% relative humidity, which is because of the higher dew point temperature. However, the existing solutions fail to consider both outdoor air temperature and dew point temperature of the environment while adjusting or maintaining the optimum humidity level within the environment, which may create an uncomfortable environment for the occupants. There is therefore a need to determine an optimum humidity level for the environment and further automatically maintain the determined optimum humidity level within the environment without any human intervention.

This invention provides a simple, improved, efficient, and cost-effective system and method for determining an optimum humidity level for an environment/area of interest (AOI) based on the outdoor temperature and dew point temperature within the environment/AOI and further maintaining the determined optimum humidity level within the environment/AOI.

Figure 2:
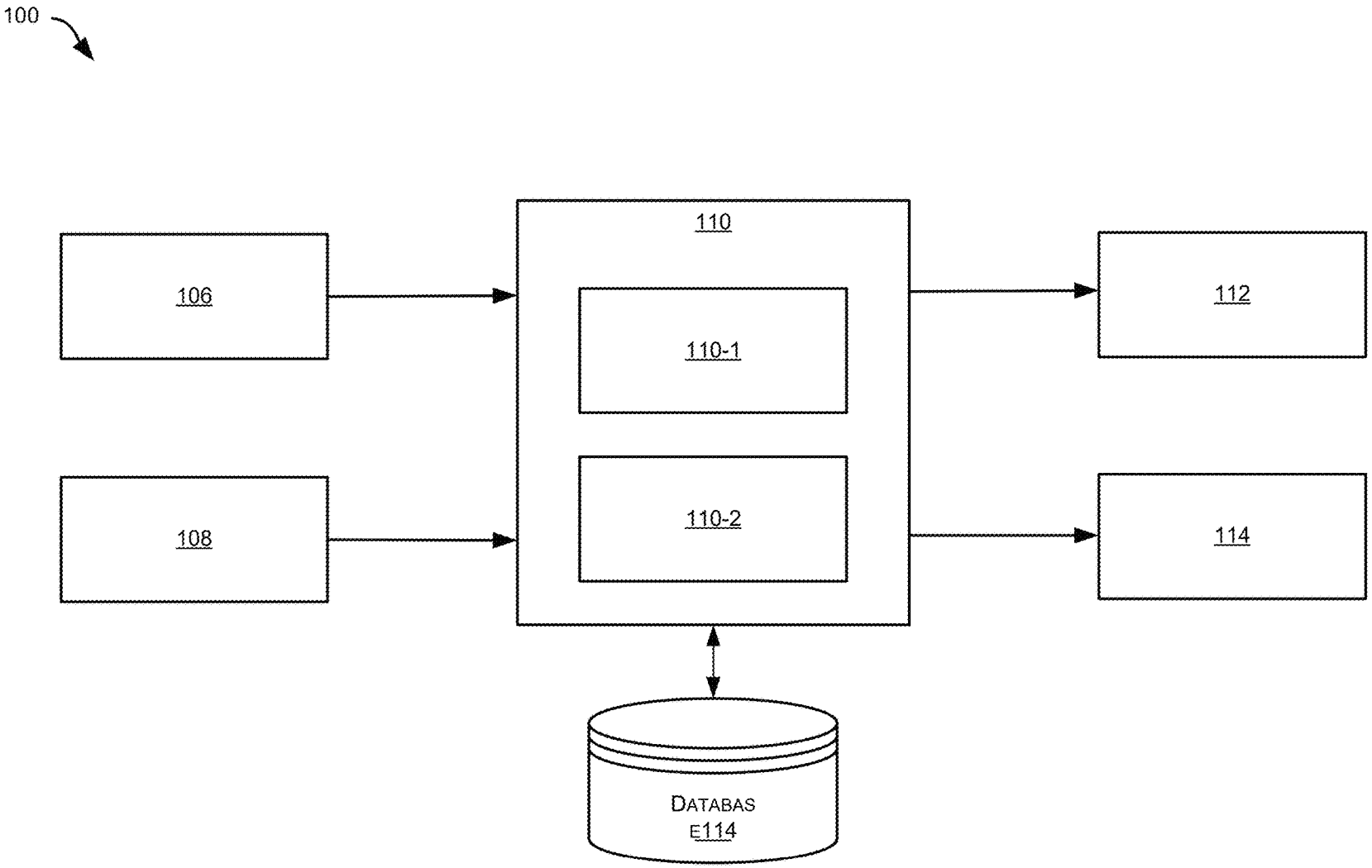
FIG. 2 illustrates an exemplary block diagram of the system of FIG. 1, in accordance with one or more embodiments of the subject disclosure.

Referring to FIGS. 1 and 2, a system 100 for determining an optimum humidity level for an area of interest (AOI) 102 (also referred to as environment 102, herein) and further maintaining the determined optimum humidity level within the AOI 102 is disclosed. The space outside or the ambient is designated as 104, herein. The AOI 102 may be a building, a container or trailer associated with a vehicle, or any other enclosed space, but not limited to the like. The system 100 may include a first sensor 106 such as an outdoor air temperature (OAT) sensor 106 that may be operable to monitor ambient air temperature (or outside air temperature) outside 104 of the AOI 102. The system 100 may further include a second sensor 108 including a dew point temperature sensor 108 that may be operable to monitor dew point temperature within the AOI 102. Further, the system 100 may include a processing device 110 in communication with the first sensor 106 and the second sensor 108. The processing device 110 may include one or more processors 110-1 coupled to a memory 110-2 storing instructions executable by the one or more processors 110-1 to enable the processing device 110 to perform one or more designated operations. The processing device 110 may be configured to receive, from the first sensor 106, the ambient/outdoor air temperature being monitored outside of the AOI 102 and further receive, from the second sensor 108, the dew point temperature being monitored within the AOI 102. However, the processing device 110 may also receive the ambient/outdoor air temperature outside of the AOI 102 and the dew point temperature being monitored within the AOI 102 from other sensors. The processing device 110 may accordingly determine the current humidity level and the apparent temperature (heat index) felt within the AOI 102 based on the received ambient air temperature and the received dew point temperature. The processing device 110 accordingly determines and maintains an optimum (comfortable) humidity level within the AOI 102. The comfortable or recommended dew point temperature for any environment/AOI may be between 32 to 59° F. The dew point temperature may determine the combinations of outside air temperature and the relative humidity. For instance, at a constant dew point, when the temperature goes up, the relative humidity may go down and when the temperature goes down, the relative humidity may go up. Therefore, the dew point may be responsible for determining which temperature setting may give a specific relative humidity.

In one or more embodiments, the recommended optimum humidity level or optimum relative humidity percentage (RH) for any environment/AOI is calculated using the below equation 1.

$$RH=100*(\mathrm{Exp}((17.625*TD)/(243.04+TD))/\mathrm{Exp}((17.625*T)/(243.04+T))) \quad \text{(Equation 1)}$$

where RH is relative humidity %, TD is the dew point temperature, T is the outside air temperature, and Exp is the exponential function.

In one or more embodiments, the processing device 110 may map the received ambient air temperature and the received dew point temperature with a database 116 comprising one or more known air temperatures, one or more known dew point temperatures, and a corresponding predetermined humidity level, to determine the humidity level to be maintained within the AOI 102. Table 1 below shows predetermined optimum humidity level for the AOI 102 for different known outdoor air temperatures, known dew point temperatures, which may be determined using the above equation 1. Table-1 further shows the actual humidity level and heat index felt within the AOI 102 for different values of known outdoor air temperatures, and known dew point temperatures. A person skilled in the art would appreciate that Table 1 provides specific optimum humidity levels for a limited range of outside air temperatures and dew point temperatures. However, it is important to note that the processing device 110 is configured to determine and maintain the optimal humidity level for a wide range of values that extend beyond those mentioned in Table 1. This capability is achieved through the utilization of Equation 1, which allows for precise calculations based on different combinations of outside air temperatures and dew point temperatures. Therefore, it should be understood that the scope of this invention encompasses all possible values and examples of outside air temperatures and dew point temperatures, regardless of whether they are explicitly listed in Table 1 or not. There are no limitations imposed on the system's ability to adapt and respond to various conditions, as long as the calculations are performed using Equation 1. This flexibility ensures that the system can effectively maintain optimum humidity levels in.

TABLE 1

| Outside Temperature(° F.) | Dew Point temperature(° F.) | Humidity(%) within the AOI | Heat Index (real feel) within the AOI | Recommended/ comfortable Humidity Level (%) for the AOI |
|---|---|---|---|---|
| 40 | 32 | 72 | 40 | 72 |
| 100 | 32 | 49 | 47 | 100 |
| 60 | 32 | 34 | 57 | 74 |
| 70 | 32 | 24 | 68 | 52 |
| 80 | 32 | 17 | 79 | 37 |
| 90 | 32 | 12 | 86 | 27 |
| 100 | 32 | 9 | 94 | 20 |
| 110 | 32 | 7 | 102 | 15 |
| 60 | 49 | 66 | 59 | 74 |
| 70 | 49 | 47 | 69 | 52 |
| 80 | 49 | 33 | 79 | 37 |
| 90 | 49 | 24 | 87 | 27 |
| 100 | 49 | 18 | 97 | 20 |
| 110 | 49 | 13 | 107 | 15 |
| 60 | 54 | 80 | 59 | 74 |
| 70 | 54 | 56 | 69 | 52 |
| 80 | 54 | 40 | 80 | 37 |
| 90 | 54 | 29 | 88 | 27 |
| 100 | 54 | 21 | 98 | 20 |
| 110 | 54 | 16 | 109 | 15 |
| 60 | 59 | 96 | 60 | 74 |
| 70 | 59 | 68 | 70 | 52 |
| 80 | 59 | 48 | 81 | 37 |
| 90 | 59 | 35 | 89 | 27 |
| 100 | 59 | 26 | 100 | 20 |
| 110 | 59 | 19 | 112 | 15 |
| 70 | 64 | 81 | 71 | 52 |
| 80 | 64 | 58 | 82 | 37 |
| 90 | 64 | 42 | 91 | 27 |

TABLE 1-continued

| Outside Temperature(° F.) | Dew Point temperature(° F.) | Humidity(%) within the AOI | Heat Index (real feel) within the AOI | Recommended/ comfortable Humidity Level (%) for the AOI |
|---|---|---|---|---|
| 100 | 64 | 31 | 103 | 20 |
| 110 | 64 | 23 | 115 | 15 |
| 70 | 69 | 96 | 71 | 52 |
| 80 | 69 | 69 | 83 | 37 |
| 90 | 69 | 50 | 95 | 27 |
| 100 | 69 | 36 | 107 | 20 |
| 110 | 69 | 28 | 120 | 15 |
| 80 | 74 | 81 | 85 | 37 |
| 90 | 74 | 59 | 99 | 27 |
| 100 | 74 | 43 | 112 | 20 |
| 110 | 74 | 33 | 126 | 15 |
| 90 | 80 | 72 | 108 | 27 |
| 100 | 80 | 53 | 122 | 20 |
| 110 | 80 | 40 | 135 | 15 |

For instance, when the ambient air temperature outside 104 is 40° F. and the dew point temperature within the AOI 102 is 40° F., the actual humidity level and temperature (heat index) felt by occupants within the AOI 102 may be 72% and 42° F., respectively. Accordingly, to provide a comfortable environment within the AOI 102, the corresponding optimum humidity level for the AOI 102 may be set and maintained at 72%. Further, when the ambient air temperature outside 104 is 90° F. and the dew point temperature within the AOI 102 is 64° F., the actual humidity level and temperature (heat index) felt by occupants within the AOI 102 may be 42% and 91° F., respectively. Accordingly, to provide a comfortable environment within the AOI 102, the corresponding optimum humidity level for the AOI 102 may be set and maintained at 27%. The heat index (also known as the apparent temperature) may be the temperature that the occupants may feel within the AOI 102 when the relative humidity is combined with the air temperature. This may have an important consideration for the occupant's/human body's comfort. Accordingly, the humidity level of the AOI 102 may be maintained at the determined optimum humidity level based on Table-1 to provide comfort to the occupants.

In one or more embodiments, the processing device 110 may be configured to allow one or more registered users to manually enter or set, upon authorization by an admin, specific values of optimum humidity level to be maintained for different combinations of the outside air temperature and the dew point temperature.

In one or more embodiments, the processing device 110 may be operatively connected to or in communication with a control unit of an HVAC system 112 associated with the AOI 102. Further, the processing device 110 may be configured to transmit data comprising the determined optimum humidity level for the AOI to the control unit of the HVAC system 112. The control unit may accordingly operate the HVAC system to automatically maintain the determined optimum humidity level within the AOI 102. In one or more embodiments, the first sensor or OAT sensor 106 may be associated with and configured within an outdoor unit associated with the existing HVAC system 112 of the AOI 102, such that the first sensor 106 may remain either outside 104 or in a supply air channel of the outdoor unit/HVAC system 112 to monitor the outdoor air temperature. Further, the second sensor 108 may be additionally positioned inside the AOI 102. For instance, the second sensor 108 may be installed on the walls or roof within the AOI 102. However, in other embodiments, the first sensor or OAT sensor 106 may not be associated with the outdoor unit of the HVAC system 112 and may either be additionally positioned outside 104 or in the supply air channel of the HVAC system to monitor the outdoor air temperature.

In one or more embodiments, the processing device 110 may be operatively coupled to or in communication with a control unit of an air humidification system 114 (also referred to as humidification/dehumidification system, herein) associated with the AOI 102. The processing device 110 may be configured to transmit data comprising the determined optimum humidity level for the AOI to the dehumidification system 114. The control unit may accordingly operate the air humidification system 114 to automatically maintain the determined optimum humidity level within the AOI 102.

In one or more embodiments, the processing device 110 may be a thermostat associated with the HVAC system 112 or the humidification system 114 of the AOI 102. Further, in other embodiments, the processing device 110 may be in communication with the thermostat associated with the HVAC system 112 or humidification system 114 of the AOI 102. Furthermore, in some embodiments, the processing device 110 may be in direct communication with a control unit or a central server associated with the HVAC system 112 or the air humidification system 114 associated with the AOI 102, such that based on instructions or data pertaining to determined optimum humidity level being received from the processing device 110, the control unit of the HVAC system 112 or the air humidification system 114 may operate the HVAC system 112 or the air humidification system 114 to maintain the determined humidity level within the AOI 102.

The processing device 110, the first (OAT) sensor 106, the second (dew point) sensor 108, the HVAC system 112, the humidification system 114, and the thermostat of the AOI 102 may include a transceiver or a communication module to communicatively connect the processing device 110 to one or more of the first sensor 106, the second sensor 108, the HVAC system 112, the humidification system 114, and the thermostat of the AOI 102, through a network via wired and/or wireless media. In one or more embodiments, the system 100 or processing device 110, and mobile devices associated with the occupants of the AOI 102 or registered users or the admin may be operatively coupled to a website and so be operable from any Internet-enabled user device. The mobile devices may allow the occupants, the users, and the admin to monitor and control the operation of the system 100. Examples of mobile devices may include but are not limited to, a portable computer, a personal digital assistant, a handheld device, and a workstation.

In one or more embodiments, the network can be a wireless network, a wired network or a combination thereof. Network can be implemented as one of the different types of networks, such as intranet, local area network (LAN), wide area network (WAN), the internet, and the like. Further, the network may either be a dedicated network or a shared network. The shared network represents an association of the different types of networks that use a variety of protocols, for example, Hypertext Transfer Protocol (HTTP), Transmission Control Protocol/Internet Protocol (TCP/IP), Wireless Application Protocol (WAP), and the like, to communicate with one another. Further, network can include a variety of network devices, including transceivers, routers, bridges, servers, computing devices, storage devices, and the like. In another implementation the network can be a cellular network or mobile communication network based on various technologies, including but not limited to, Global System 100 for Mobile (GSM), General Packet Radio Service (GPRS), Code Division Multiple Access (CDMA), Long Term Evolution (LTE), WiMAX, 5G or 6G network protocols, and the like.

Figure 3:
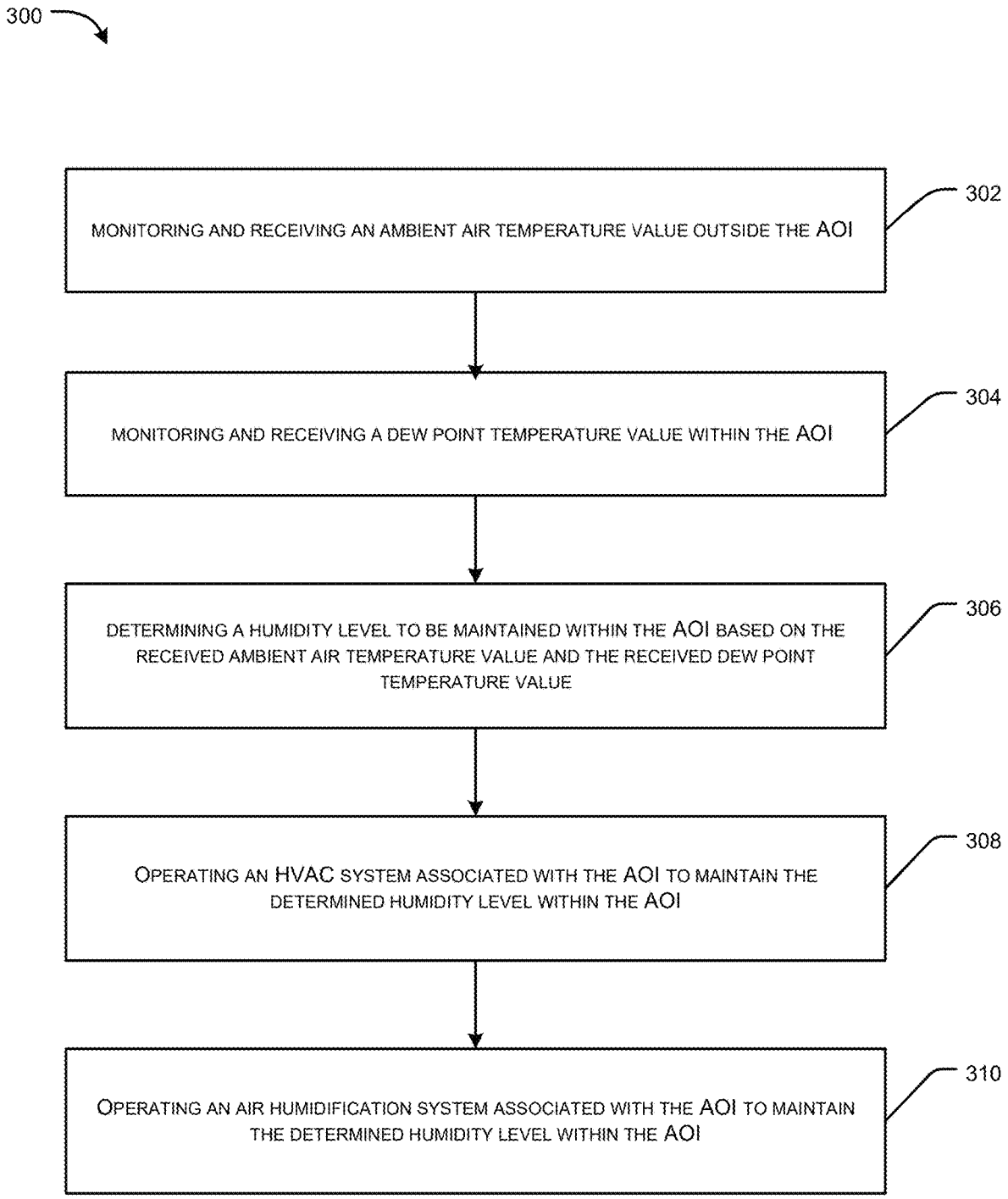
FIG. 3 illustrates an exemplary flow diagram of a method for determining an optimum humidity level for an area of interest (AOI) and further maintaining the determined optimum humidity level within the AOI, in accordance with one or more embodiments of the subject disclosure.

Referring to FIG. 3, method 300 for determining an optimum humidity level for an area of interest (AOI is disclosed. Method 300 may involve the processing device 110, the first sensor (outdoor air temperature sensor) 106, the second sensor (dew point temperature sensor) 108, the HVAC system 112, the humidification system 114, and the thermostat and other components associated with the system 100 of FIGS. 1 and 2. Method 300 may include step 302 monitoring and receiving an ambient air temperature value outside the AOI and another step 304 of monitoring and receiving a dew point temperature value within the AOI. Further, method 300 may include step 306 of determining a humidity level to be maintained within the AOI based on the received ambient air temperature and the received dew point temperature.

In one or more embodiments, step 306 may involve mapping the received ambient air temperature value and the received dew point temperature value with a database comprising one or more known outdoor air temperatures, one or more known dew point temperatures, and a corresponding predetermined humidity level, to determine the humidity level to be maintained within the AOI. Table 1 already shows different known outdoor air temperatures, known dew point temperatures, and corresponding predetermined optimum humidity levels, which may facilitate in determining the optimum humidity level for the AOI.

In one or more embodiments, method 300 may include step 308 of operating an HVAC system associated with the AOI to maintain the determined humidity level within the AOI. Further, in other embodiments, method 300 may include step 310 of operating an air humidification/dehumidification system associated with the AOI to maintain the determined humidity level within the AOI.

In one or more embodiments, the humidification/dehumidification system may be a standalone device such as a humidifier and a dehumidifier, however, the humidifier and dehumidifier may also be integrated with the HVAC system of the AOI.

The HVAC system 112 or humidification/dehumidification system 114 may maintain the determined optimum humidity level at the AOI 102 by one or more of enabling dehumidification of the supply air, humidification of the supply air, controlling the speed of fan associated with the HVAC system 112, adjusting the temperature of the supply air, and the like.

The HVAC system 112 may remove excess moisture from the air. This may be done using a dehumidifier, which can be a standalone unit or integrated into the HVAC system 112. Dehumidifier may work by pulling in moist air and passing it over a cooling coil, which may condense the moisture and allow it to be drained away. In addition, the HVAC system 112 may add moisture to the air using a humidifier. This may be especially useful in dry climates or during the winter when indoor heating can dry out the air. Humidifier may work by evaporating water into the air, typically using a wick or steam. Further, the HVAC system 112 may be operated to adjust the airflow in the AOI to regulate the humidity levels. This may be done by controlling the speed of fans or adjusting dampers to allow more or less outside air to enter the AOI 102. Furthermore, the HVAC system 112 may indirectly control humidity at the AOI 102 by adjusting the temperature of the AOI 102. As warmer air may hold more moisture, so increasing the temperature of the AOI 102 may help reduce relative humidity. Conversely, lowering the temperature of the AOI 102 may increase relative humidity within the AOI 102.

Thus, the invention provides a simple, improved, efficient, and cost-effective system and method for determining an optimum humidity level for an environment/area of interest (AOI) based on the outdoor temperature and dew point temperature within the environment/AOI and further maintaining the determined optimum humidity level within the environment/AOI.

Figure 4:
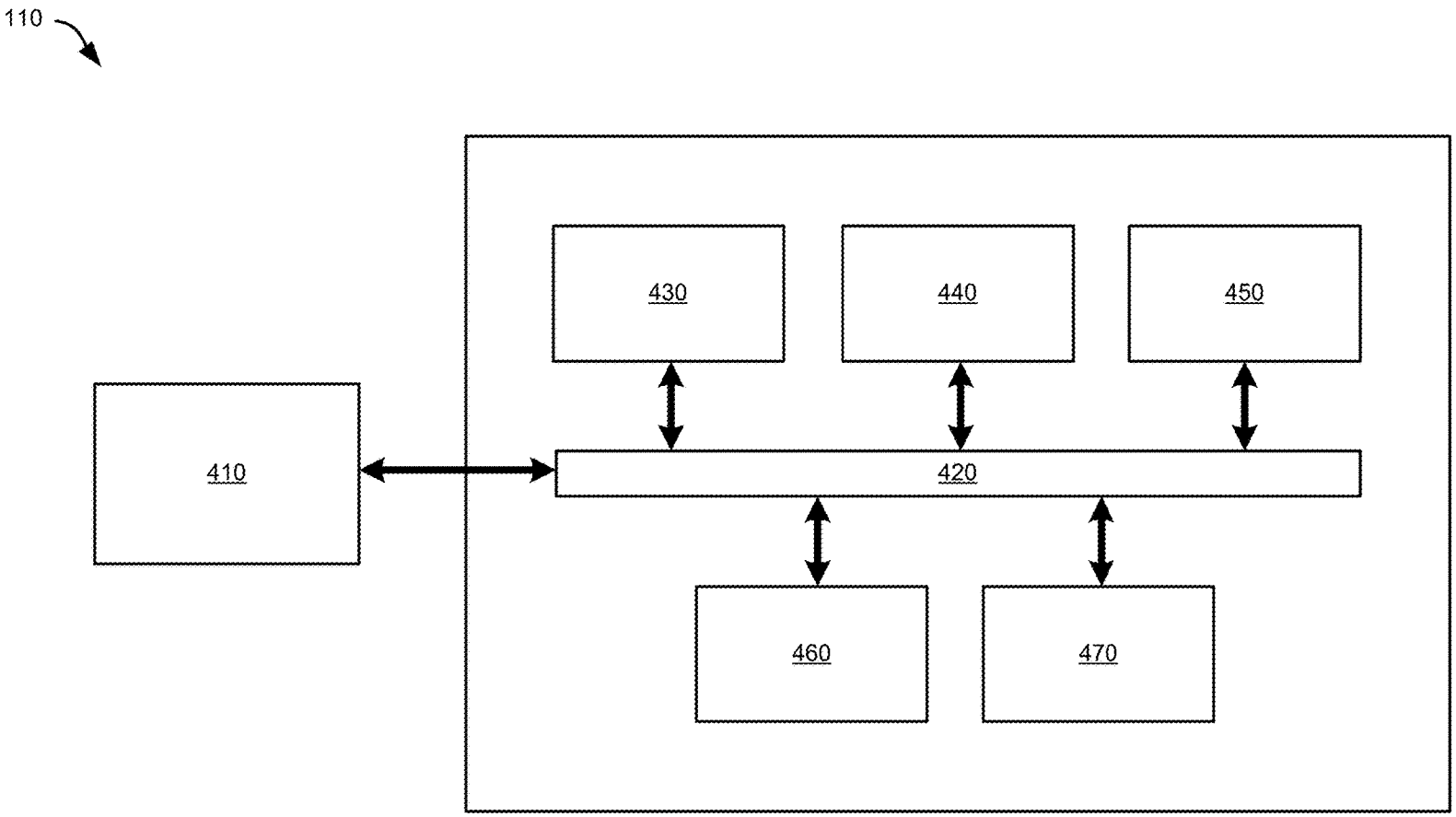
FIG. 4 illustrates an exemplary schematic block diagram of a hardware system used for implementing the processing device of FIG. 1, in accordance with one or more embodiments of the subject disclosure.

FIG. 4 is an exemplary schematic block diagram of a hardware system used for implementing the processing device. As shown in FIG. 4, the processing device can include an external storage device 410, a bus 420, a main memory 430, a read only memory 440, a mass storage device 450, communication port 460, and a processor 470. A person skilled in the art will appreciate that the processing device may include more than one processor and communication ports. Examples of processor 470 include, but are not limited to, an Intel® Itanium® or Itanium 2 processor(s), or AMD® Opteron® or Athlon MP® processor(s), Motorola® lines of processors, FortiSOC™ system on chip processors or other future processors. Processor 470 may include various modules. Communication port 460 can be any of an RS-232 port for use with a modem-based dialup connection, a 10/100 Ethernet port, a Gigabit or 10 Gigabit port using copper or fibre, a serial port, a parallel port, or other existing or future ports. Communication port 460 may be chosen depending on a network, such a Local Area Network (LAN), Wide Area Network (WAN), or any network to which processing device connects. Memory 430 can be Random Access Memory (RAM), or any other dynamic storage device commonly known in the art. Read-only memory 440 can be any static storage device(s) e.g., but not limited to, a Programmable Read Only Memory (PROM) chips for storing static information e.g., start-up or BIOS instructions for processor 470. Mass storage 450 may be any current or future mass storage solution, which can be used to store information and/or instructions. Exemplary mass storage solutions include, but are not limited to, Parallel Advanced Technology Attachment (PATA) or Serial Advanced Technology Attachment (SATA) hard disk drives or solid-state drives (internal or external, e.g., having Universal Serial Bus (USB) and/or Firewire interfaces), e.g. those available from Seagate (e.g., the Seagate Barracuda 7102 family) or Hitachi (e.g., the Hitachi Deskstar 7K1000), one or more optical discs, Redundant Array of Independent Disks (RAID) storage, e.g. an array of disks (e.g., SATA arrays), available from various vendors including Dot Hill Systems Corp., LaCie, Nexsan Technologies, Inc. and Enhance Technology, Inc.

Bus 420 communicatively couples processor(s) 470 with the other memory, storage, and communication blocks. Bus 420 can be, e.g., a Peripheral Component Interconnect (PCI)/PCI Extended (PCI-X) bus, Small Computer System Interface (SCSI), USB or the like, for connecting expansion cards, drives and other subsystems as well as other buses, such a front side bus (FSB), which connects processor 470 to software system.

Optionally, operator and administrative interfaces, e.g., a display, keyboard, and a cursor control device, may also be coupled to bus 420 to support direct operator interaction with processing device. Other operator and administrative interfaces can be provided through network connections connected through communication port 460. The external storage device 410 can be any kind of external hard-drives, floppy drives, IOMEGA® Zip Drives, Compact Disc-Read Only Memory (CD-ROM), Compact Disc-Re-Writable (CD-RW), Digital Video Disk-Read Only Memory (DVD-ROM). Components described above are meant only to exemplify various possibilities. In no way should the aforementioned exemplary processing device limit the scope of the subject disclosure.

While the subject disclosure has been described with reference to exemplary embodiments, it will be understood by those skilled in the art that various changes may be made and equivalents may be substituted for elements thereof without departing from the scope of the subject disclosure as defined by the appended claims. Modifications may be made to adopt a particular situation or material to the teachings of the subject disclosure without departing from the scope thereof. Therefore, it is intended that the subject disclosure not be limited to the particular embodiment disclosed, but that the subject disclosure includes all embodiments falling within the scope of the subject disclosure as defined by the appended claims.

In interpreting the specification, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N. or B plus N, etc.

The invention claimed is:

1. A system for determining and maintaining an optimum humidity level for an area of interest (AOI), the system comprising:

a first sensor operable to monitor ambient air temperature outside the AOI;

a second sensor operable to monitor dew point temperature within the AOI; and one or more processors in communication with the first sensor and the second sensor, wherein the one or more processors are coupled to a memory storing instructions executable by the one or more processors, and wherein the one or more processors are configured to:

receive, from the first sensor, the ambient air temperature being monitored outside the AOI;

receive, from the second sensor, the dew point temperature being monitored within the AOI;

determine, based on (i) the received ambient air temperature and (ii) the received dew point temperature, the optimum humidity level to be maintained within the AOI, wherein the optimal humidity level to be maintained is determined in accordance with a database mapping the received ambient air temperature and the received dew point temperature to the optimum humidity level to maintain an apparent temperature felt within the AOI; and operate one or more of an HVAC system and an air humidification system associated with the AOI to maintain the determined optimum humidity level within the AOI.

2. The system of claim 1, wherein the database comprises one or more known outdoor air temperatures, one or more known dew point temperatures, and a corresponding predetermined humidity level of the one or more outdoor air temperatures and the one or more known dew point temperatures, to determine the optimum humidity level to be maintained within the AOI, and wherein the determined optimum humidity level is the corresponding predetermined humidity level after the mapping.

3. The system of claim 1, wherein the one or more processors are operatively connected to the HVAC system associated with the AOI, and wherein the one or more processors are further configured to transmit data comprising the determined optimum humidity level for the AOI to the HVAC system.

4. The system of claim 1, wherein the one or more processors are in communication with the air humidification system associated with the AOI, and wherein the one or more processors are further configured to transmit data comprising the determined optimum humidity level for the AOI to the air humidification system.

5. The system of claim 1, wherein the first sensor is positioned outside the AOI and the second sensor is positioned inside the AOI.

6. The system of claim 1, wherein the one or more processors correspond to a thermostat associated with the HVAC system of the AOI.

7. The system of claim 1, wherein the one or more processors are in communication with a thermostat associated with the HVAC system of the AOI.

8. A system for maintaining an optimum humidity level within an area of interest (AOI), the system comprising:

a first sensor operable to monitor ambient air temperature outside the AOI;

a second sensor operable to monitor dew point temperature within the AOI; and one or more processors in communication with an HVAC system, the first sensor, and the second sensor, wherein the one or more processors are coupled to a memory storing instructions executable by the one or more processors, wherein the one or more processors are configured to:

receive, from the first sensor, the ambient air temperature being monitored outside the AOI;

receive, from the second sensor, the dew point temperature being monitored within the AOI;

determine, based on (i) the received ambient air temperature and (ii) the received dew point temperature, the optimum humidity level to be maintained within the AOI, wherein the optimal humidity level to be maintained is determined in accordance with a database mapping the received ambient air temperature and the received dew point temperature to the optimum humidity level to maintain an apparent temperature felt within the AOI; and operate one or more of the HVAC system and an air humidification system associated with the AOI to maintain the determined optimum humidity level within the AOI.

9. The system of claim 8, wherein the database comprises one or more known outdoor air temperatures, one or more known dew point temperatures, and a corresponding predetermined humidity level of the one or more outdoor air temperatures and the one or more known dew point temperatures, to determine the optimum humidity level to be maintained within the AOI, and wherein the determined optimum humidity level is the corresponding predetermined humidity level after the mapping.

10. The system of claim 8, wherein the first sensor is configured with an outdoor unit associated with the HVAC system of the AOI, and the second sensor is positioned inside the AOI.

11. The system of claim 8, wherein the one or more processors correspond to a thermostat associated with the HVAC system of the AOI.

12. The system of claim 8, wherein the one or more processors are in communication with a thermostat associated with the HVAC system of the AOI.

13. The system of claim 8, wherein the one or more processors are in communication with the HVAC system or the air humidification system associated with the AOI.

14. A method for determining and maintaining an optimum humidity level for an area of interest (AOI), the method comprising the steps of:

monitoring and receiving an ambient air temperature value outside the AOI;

monitoring and receiving a dew point temperature value within the AOI;

determining, based on (i) the received ambient air temperature and (ii) the received dew point temperature, the optimum humidity level to be maintained within the AOI, wherein the optimal humidity level to be maintained is determined in accordance with a database mapping the received ambient air temperature and the received dew point temperature to the optimum humidity level and apparent temperature felt within the AOI; and operating one or more of an HVAC system and an air humidification system associated with the AOI to maintain the determined optimum humidity level within the AOI.

15. The method of claim 14, wherein the database comprises one or more known outdoor air temperatures, one or more known dew point temperatures, and a corresponding predetermined humidity level of the one or more outdoor air temperatures and the one or more known dew point temperatures, to determine the optimum humidity level to be maintained within the AOI, and wherein the determined optimum humidity level is the corresponding predetermined humidity level after the mapping.

* * * * *